United States Patent [19]

McCarty

[11] 4,439,995

[45] Apr. 3, 1984

[54] AIR CONDITIONING HEAT PUMP SYSTEM HAVING AN INITIAL FROST MONITORING CONTROL MEANS

[75] Inventor: William J. McCarty, Louisville, Ky.

[73] Assignee: General Electric Company, Louisville, Ky.

[21] Appl. No.: 365,419

[22] Filed: Apr. 5, 1982

[51] Int. Cl.[3] ..... F25D 21/10

[52] U.S. Cl. ..... 62/156; 62/282

[58] Field of Search ..... 62/82, 282, 156, 151, 62/160, 140

[56] References Cited

U.S. PATENT DOCUMENTS

| | | | |
|---|---|---|---|
| 2,001,027 | 5/1935 | Kitzmiller | 62/2 |
| 2,178,807 | 11/1939 | Ploeger | 62/4 |
| 2,525,869 | 10/1950 | Corhanidis | 62/149 |
| 2,947,153 | 8/1960 | Atchison | 62/156 |
| 3,115,017 | 12/1963 | Kocher et al. | 62/155 |
| 3,466,888 | 9/1969 | Kyle | 62/160 X |
| 4,086,779 | 5/1978 | Lewis | 62/140 |
| 4,102,391 | 7/1978 | Noland et al. | 62/156 |
| 4,245,482 | 1/1981 | Abraham | 62/256 |
| 4,338,790 | 7/1982 | Saunders et al. | 62/156 |
| 4,373,350 | 2/1983 | Noland | 62/156 |

*Primary Examiner*—Henry C. Yuen
*Assistant Examiner*—Harry Tanner
*Attorney, Agent, or Firm*—Frank P. Giacalone; Radford M. Reams

[57] ABSTRACT

The present invention relates to a self-contained air conditioning unit and more particularly to a control system having a plurality of sensing means wherein a frost monitoring control is initiated in combination with the outdoor fan in a selected outdoor heat exchanger surface temperature and outdoor ambient temperature range and frost present on the surface of the outdoor heat exchanger, and a second stage defrost initiated in combination with an auxiliary heater at a below preselected temperature.

6 Claims, 3 Drawing Figures

AIR CONDITIONING HEAT PUMP SYSTEM HAVING AN INITIAL FROST MONITORING CONTROL MEANS

BACKGROUND OF THE INVENTION

The present invention relates to a frost control system for self-contained air conditioning units. Typically, the units are adapted to be mounted in the outer wall of an enclosure to be conditioned and comprise a housing which is divided into an indoor section and an outdoor section and utilized for heating the air from the enclosure during the winter and cooling the air from the enclosure during the summer. An indoor heat exchanger is disposed in the indoor section while an outdoor heat exchanger and usually the compressor are located in the outdoor section. The compressor is reversibly connected to the heat exchangers so that the indoor heat exchanger functions as an evaporator when the unit is operating in the cooling cycle and the outdoor heat exchanger functions as the evaporator in the heating cycle. Suitable independent fan means are provided for circulating indoor air over the indoor heat exchanger and outdoor air over the outdoor heat exchanger during operation of the system in either the heating or cooling cycle.

The control system of the present invention can be used in reversible type heat pumps or in a refrigeration system having a unidirectional refrigerant flow wherein the condenser and evaporator retain their functions, but the air directed across them is redirected for different operations. This type is generally known as a reverse air cycle heat pump and, in the cooling mode, outdoor air is passed through the condenser and indoor air is passed through the evaporator. Conversely, in the heating mode, outdoor air is passed through the evaporator and indoor air is passed through the condenser.

In either type heat pump, under certain operating conditions with the unit in the heating cycle, the heat exchanger functioning as the evaporator is subjected to outside air and may operate at ambient temperature and conditions that will cause the accumulation of a coating or layer of frost thereon. Since a frost layer operates as a barrier to heat transfer between the evaporator and the air being circulated therethrough, the efficiency of the unit is markedly reduced. Also, unless means are provided for interrupting this accumulation of frost, the evaporator surface can become completely covered with a layer of frost which may eventually cause motor failure or other damage to the unit.

In many prior art systems, frost control means operable in the heating cycle are provided wherein a frost sensing element is employed to detect the presence of frost on the heat exchanger exposed to outdoor ambient and functioning as an evaporator. In some control systems employed in reverse cycle heat pumps, the presence of frost on the heat exchanger exposed to outdoor ambient causes the refrigerant system flow to reverse and the frost laden heat exchanger allowed to function as the system condenser until the frost is eliminated. At the same time, in some control systems, the heating process continues by energizing an electric resistance heater so that warm air is circulated into the enclosure being heated. In other prior art frost control systems employed in either the reverse refrigerant or air cycle heat pump, the presence of frost on the heat exchanger exposed to outdoor ambient causes the deenergization of the compressor, thereby interrupting the heating cycle until the layer of frost is eliminated. In this instance, an electric resistance heater may be energized to supply heat to the enclosure while the frost is being disposed of.

In both types of defrost systems, it is necessary that the heating process be interrupted while the frost layer is disposed of. Accordingly, by the present invention a control is provided to eliminate frost when present under certain ambient conditions without interrupting the normal cycling of the unit in the heating cycle.

SUMMARY OF THE INVENTION

The present invention relates to a self-contained air conditioning unit for heating and cooling an enclosure. The refrigerant system includes a compressor, a first heat exchanger and a second exchanger connected in a closed circuit. A fan associated with each of the heat exchangers is located for moving air through its respective heat exchanger. The fans are operable whereby indoor air is circulated through the heat exchanger functioning as the system condenser during the heating cycle and is circulated through the heat exchanger functioning as the system evaporator during the cooling cycle.

A control is provided which includes an enclosure temperature selecting thermostat operable for controlling operation of the compressor and fan means for maintaining the temperature of the enclosure within a selected temperature range. A frost control means having a frost sensing element positioned for detecting a layer of frost on the heat exchanger that is exposed to outdoor ambient and functioning as an evaporator in the heating cycle. The frost control means is operable for deenergizing the compressor and the fan means associated with the heat exchanger functioning as an evaporator when the temperature sensed by the sensing element is below a preselected frost accumulation level.

The control further provides a frost monitoring control means including a sensing element for sensing outdoor temperature and the temperature of the heat exchanger functioning as an evaporator, including means associated with the sensing element for energizing the fan means associated with the heat exchanger functioning as an evaporator when the compressor is deenergized through the enclosure temperature selecting thermostat so that outdoor air is allowed to circulate through the heat exchanger to remove frost while the compressor is in an off period during normal cycling operation of the unit in the heating cycle and the unit under control of the temperature selecting thermostat.

DESCRIPTION OF THE PREFERRED EMBODIMENTS

Figure 1:
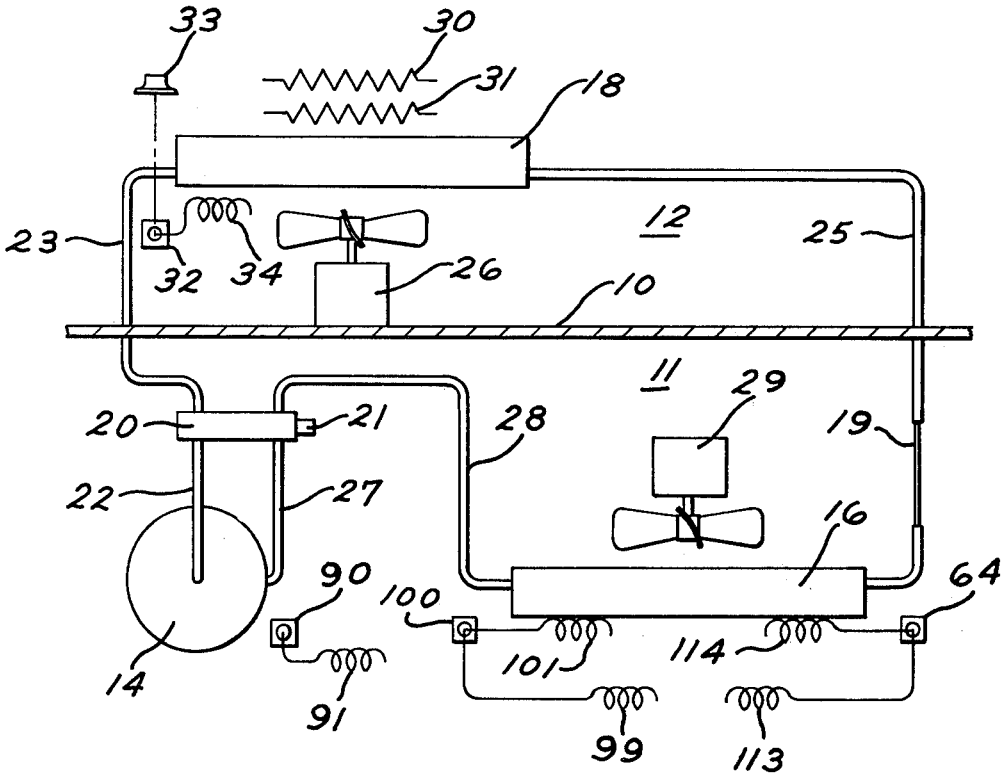
FIG. 1 is a diagrammatic view of a self-contained heat pump air conditioner embodying this invention.

Referring to FIG. 1 of the drawing, there is shown schematically an air conditioning refrigeration system of the reversible or heat pump type divided by means of a partition 10 into an outdoor section 11 and an indoor section 12. A reverse cycle refrigeration system comprises a compressor 14 and an outdoor heat exchanger 16 mounted within the outdoor section 11 and an indoor heat exchanger 18 mounted within the indoor section 12. The outdoor heat exchanger 16 and indoor heat exchanger 18 are connected by means of a suitable flow restriction means such as a capillary tube 19 while the compressor 14 is connected to the heat exchangers through a reversing valve 20 operated by a solenoid 21 so that the indoor heat exchanger 18 can be connected to the compressor either as an evaporator or as the condenser component of the refrigeration system.

During operation of the system as a heat pump or in the heating cycle, the reversing valve 20 directs the flow of high temperature refrigerant gas from the discharge line 22 of compressor 14 through a line 23 into the indoor heat exchanger 18 which then functions as a condenser to warm the air to be conditioned, and to condense the refrigerant gas into liquid form. The refrigerant is partially or completely condensed by the air circulated through the indoor heat exchanger 18 by the indoor fan 26. The refrigerant then flows through line 25 including expansion device 19 to the outdoor heat exchanger which is now functioning as an evaporator through line 28 and then back through valve 20, suction line 27, and into the compressor 14.

During operation of the system in the cooling cycle, high pressure refrigerant gas is directed by the reversing valve 20 into the outdoor heat exchanger 16 through line 28 where the high pressure refrigerant gas is condensed by the air circulated through heat exchanger 16 by the outdoor fan 29. The refrigerant then flows through line 25 including expansion device 19 to the indoor heat exchanger 18, which is now functioning as an evaporator, and then back through line 23, valve 20, suction line 22 and into the compressor 14.

Two auxiliary or supplemental heaters in the form of electrical resistance heaters 30 and 31 are provided in the indoor section in the downstream path of air flowing through the indoor heat exchanger 18 for the purpose of supplying heat to the indoor during defrosting of the outdoor heat exchanger, or for providing supplemental heating during the heating cycle.

Positioned within the indoor section 12 of the unit at some point in the airstream flowing through the heat exchanger 18 is a temperature selecting thermostat 32 which controls the operation of the unit on either the heating or the cooling cycle. This thermostat 32 may include a temperature setting or selection knob 33 positioned so as to be adjustable by the user of the air conditioner. Thermostat 32 may be any one of the types well known in the art, and, as employed in the present embodiment of the invention, includes sensing element 34 positioned in the air flow so as to respond to the temperature of the recirculating indoor air. In the illustrated embodiment of the invention, this temperature responsive means 34 is arranged in the airstream flowing from the enclosure into the indoor section 12 and then through the heat exchanger 18.

Figure 2:
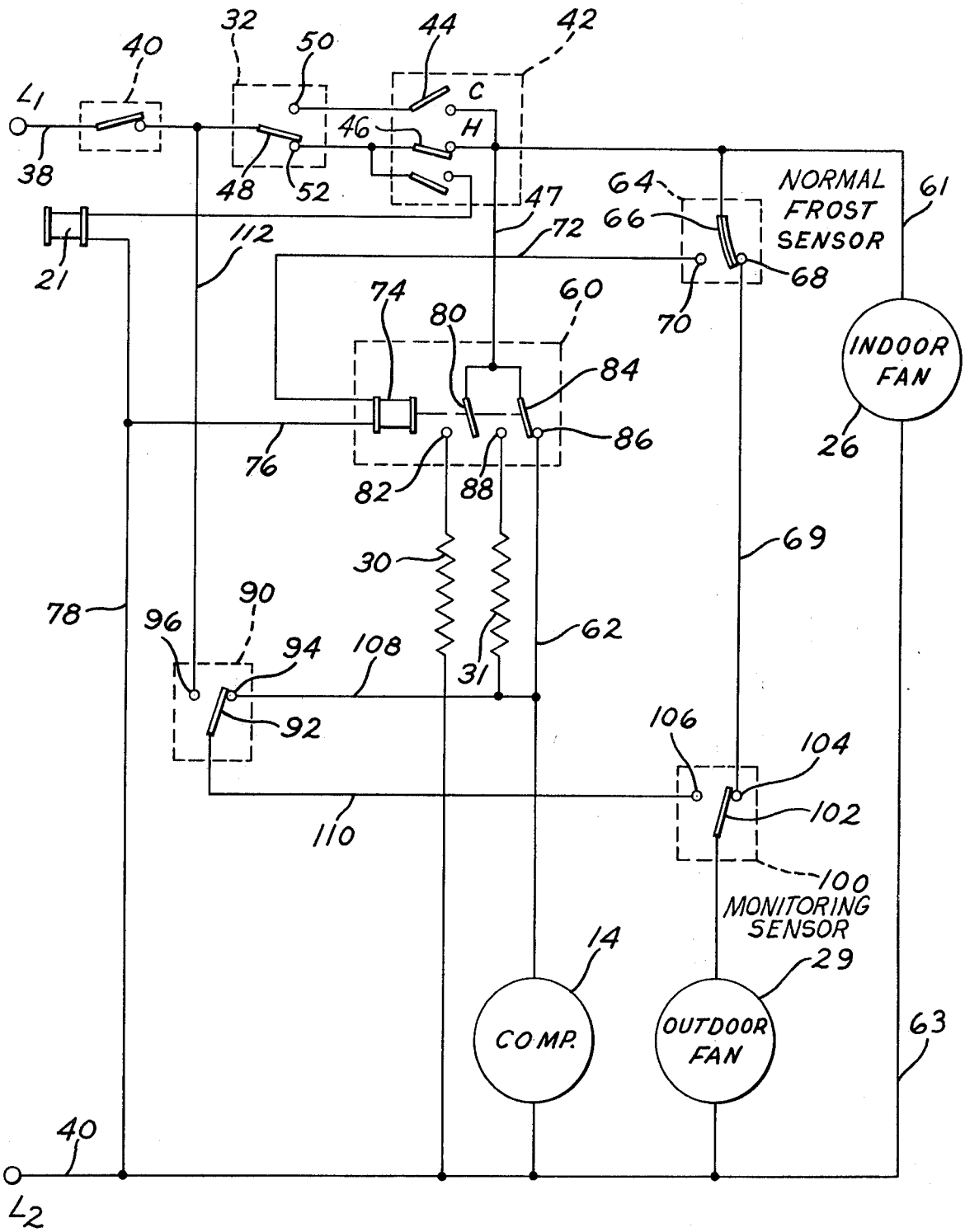
FIG. 2 is a simplified schematic diagram of electrical control circuitry adapted to control the unit in accordance with the present invention.

Referring now to FIG. 2, there is shown a control circuit for the air conditioning unit which includes means providing a frost monitoring or preliminary defrost stage. The frost monitoring means is operable during the normal cycling of the unit in the heating mode. The frost monitoring means is effective in controlling frost while the unit is cycling through the thermostat 32. The frost monitoring means is intended by the present invention to provide frost control when the ambient outdoor temperature is in the 30° F. to 45° F. range. In this range the compressor is typically cycling and maintaining the indoor ambient of the selected temperature through the thermostat 32. The present control also includes means for providing heat to the compressor casing and the outdoor fan motor when the system is in the normal or stage defrost mode. The illustrative circuit is merely representative of a control means for carrying out the present invention and any number of circuits or components may be utilized in carrying out the present invention of providing frost control during normal operation of the unit. For a more complete understanding of the control circuitry regarding the frost monitoring stage defrost operation and the manner in which heat is applied to the compressor casing and the outdoor fan by the present embodiment, reference is made to the wiring diagram shown in FIG. 2 of the drawing. The air conditioning unit is energized through a main on/off switch 40, room thermostat 32 and a selector switch 42 which selects the operation of the unit on either the heating or cooling cycle. Switch 42 includes a cooling switch 44 and a heating switch 46 by which the cooling or heating cycle is selected. Room thermostat 32 includes a switch 48 that is movable either between a cooling contact 50, or a heating contact 52. In the normal operation of the unit in either the heating or cooling cycle, operation of the compressor is from line L1 through switches 40, 32, 42, line 47, and through switch 84 of a switching apparatus 60 (to be explained later), line 62, compressor 14 and thence to line L2. The indoor fan 26 operates under control of the thermostat 32 and a circuit therethrough is completed from selector switch 42 through lines 61 and 63 to line L2. Operation of the outdoor fan 29 from switch 42 is through a outdoor frost sensing thermostat 64 positioned to detect the presence of frost on heat exchanger 16, line 69, and through switch 100 which is part of the frost monitoring means and whose operation will be explained later.

Referring to FIG. 1, a normal frost sensing thermostat 64 includes a first sensing element 113 for sensing outdoor ambient and a second sensing element 114 for sensing the surface temperature of the outdoor heat exchanger 16. Referring again to FIG. 2, the frost sensing thermostat 64 also includes a temperature responsive switch 66 movable between a normally closed contact 68 and a contact 70. As will be explained fully below, a circuit is normally completed through contact 68 through line 69, to energize the outdoor fan 29 under control of thermostat 32, while a circuit is completed through contact 70 only when switch member 66 moves because frost is present on the outdoor heat exchanger or evaporator of the unit in the heating cycle.

The sensing of a layer of frost on the evaporator 16 by the normal frost sensing thermostat 64 causes switch member 66 to engage contact 70, placing the unit in the defrost mode which deenergizes the outdoor fan 16 and completes a circuit through line 72 to a relay 74 of the switching apparatus 60, thence through lines 76 and 78 to power line L2. The relay 74 includes a first relay switch means 80 movable relative to its contact 82 for energizing the heater 30 during the defrost operation, and the relay switch means 84 movable between a normally closed contact 86 to provide a circuit, as stated above, through line 62 for operation of the compressor 14 during normal operation in either the cooling or heating cycle and a contact 88 which in the defrost mode completes a circuit from switch 42, line 47 through heater 31 in series with the compressor 14 to line L2.

The resistance of heater 31 is such that the compressor motor in a 120 V. potential sees less than 60 V. This arrangement of providing a resistor in series with the compressor effectively passes current through the compressor motor in a stalled mode which causes generation of heat that is sufficient to raise and maintain the temperature of the gaseous refrigerant in the casing of the compressor at approximately 150° F.

In most outdoor ambient conditions, the normal heat generated by the already warm refrigerant in the condenser together with the added heat of the relatively warm compressor components is sufficient to prevent the refrigerant from condensing in the compressor casing during a wide range of outdoor ambient conditions. The heater 30 is normally energized through relay switch 80 during each defrost as shown in FIG. 2. Accordingly, in an alternative circuit control, heater 30 may be eliminated. It should be noted that besides maintaining the refrigerant in the compressor casing at a selected temperature, the warm casing arranged in the outdoor section of the unit aids in the removal of frost from the outdoor heat exchanger.

In normal operation of the air conditioning unit in the heating cycle the unit capacity is sufficient that the unit compressor and fan will cycle on and off while the enclosure is maintained at the selected temperature. Under some outdoor ambient conditions wherein the free moisture in the outdoor air is high enough, frost will build up on the surface of the outdoor heat exchanger while the unit is cycling. As an example of such ambient conditions, if the outdoor ambient is between 30° F. and 45° F. the heat pump will normally cycle through the room thermostat 42 while maintaining the enclosure at a selected temperature. Since the free moisture in the air at these temperatures is higher than at lower ambient temperatures, frost will start to build up each time the compressor cycles on and eventually the outdoor heat exchanger will be covered by a layer of frost. The frost control thermostat will sense this frost buildup and the unit will go into the defrost mode, in which case the compressor 14 and outdoor fan 29 are deenergized and resistance heaters 30, 31 are energized, as explained above, to maintain the enclosure at the selected temperature.

The rate of frost buildup on the outside heat exchanger is a function of many variables, but in general it is most rapid and troublesome with a high humidity outdoor ambient in the temperature range from 45° F. to approximately 35° F. As the ambient temperature decreases below 35° F., the rate of frost buildup also decreases since the amount of free moisture in the air decreases.

In normal operation of a heat pump the majority of defrost cycles initiated by the normal frost sensor will occur because of the amount of free moisture when the outdoor temperatures are between 30° F. and 45° F. In this temperature range, as noted above, the unit is cycling through the room thermostat because the system capacity exceeds the heating loads. In effect, the unit capacity is sufficient to maintain the enclosure at a selected temperature and operation of the unit is interrupted only because of frost accumulating on the outdoor heat exchanger or evaporator.

By employing the frost monitoring stage of the present invention, the outdoor heat exchanger is maintained free of frost when the outdoor temperature is in the 30° F. to 45° F. range in a manner that does not interfere with the normal heat pump operation when required to maintain the enclosure at the selected temperature. In fact, it reduces or eliminates in many instances the accumulation of frost on the outdoor coil and, accordingly, reduces the need for the unit to go into the defrost mode wherein operation of the compressor is interrupted until all the frost is removed from the outdoor heat exchanger. Further, by the present invention means are provided wherein the outdoor fan would not run in a dry ambient where frost is not likely to accumulate during the compressor off cycle.

Referring to FIG. 1, the frosting monitoring means for carrying out the present invention includes an ambient sensor 90 having a sensing element 91 for sensing outdoor temperature and a frost monitoring sensor 100 having a first sensing element 99 for sensing outdoor ambient and a second sensing element 101 for sensing the surface temperature of the outdoor heat exchanger 16. Referring now to FIG. 2, the sensor 90 includes a switch member 92 movable between a contact 94 and a contact 96. The sensor 100 includes a switch member 102 movable between a contact 104 and a contact 106. As mentioned above, the normal circuit through normal outdoor fan 29 is through frost sensor 64 line 69 and switch 100 in which, in its normal position as shown, switch member 102 is in engagement with contact 104. With reference to sensor 90, contact 96 is connected to line L1 through line 112, contact 94 is connected through a line 108 to line 62, while switch member 92 is connected through line 110 to contact 106 of sensor 100.

Under normal operating conditions, when the outdoor temperature is above 35° F. and no frost is present on the surface of the outdoor heat exchanger 16, switch member 92 will be in engagement with contact 96 and switch member 102 will be in engagement with contact 104. As stated above, in this instance the fan 29 will cycle with the compressor through thermostat switch 46. In the same temperature range of above 35° F., however, if the surface of the outdoor heat exchanger 16 is approximately half covered with frost, switch member 102 will move into engagement with contact 106. At this time, a circuit is completed from line L1 through line 112, switch contact 96 of sensor 90, thence through line 110, contact 106 of switch 100, to energize the outdoor fan 29 and maintain it operational even when the compressor is cycled off through room thermostat 42. This movement of air through the outdoor heat exchanger will at these ambient outdoor temperatures raise the surface temperature of the heat exchanger and melt frost from the surface thereof when the compressor is deenergized.

In the event the outdoor temperature drops below 32° F. and no frost is present on the outdoor heat exchanger, switch member 92 will be in engagement with contact 94, while switch member 102 will remain in engagement with contact 104, in which case the outdoor fan 29 will continue to cycle with the compressor. The air at these temperatures has a small percentage of free moisture and the rate of frost buildup is minimal.

In the same temperature range of below 32° F., however, if the surface of the outdoor heat exchanger 16 is approximately half covered with frost, switch member 102 will be in engagement with contact 106; however, switch member 92 will move into engagement with contact 94, in which case fan 29 will cycle with the compressor through room thermostat 42 since the fan will, through line 108, be in parallel with the compressor. In this instance, if the layer of frost covers substantially all of the surface of the outdoor heat exchanger 16, the normal frost sensor switch 66 will move to engage contact 70 and the normal defrost cycle will be instituted. With the switches 100 and 90 in this position and relay 74 energized, fan motor 29 would be in series with heater 31 and will not receive sufficient voltage to operate but would receive enough voltage to warm the motor and provide heat in the same manner as the compressor which is also in series with heater 31.

In carrying out the present invention, the sensor 100 was selected because of its ability to determine the ΔT or difference between outdoor ambient temperature and the outdoor heat exchanger surface temperature. To this end, the device used is available from Ranco Corporation and is identified as Type D52 Automatic Deicer.

Figure 3:
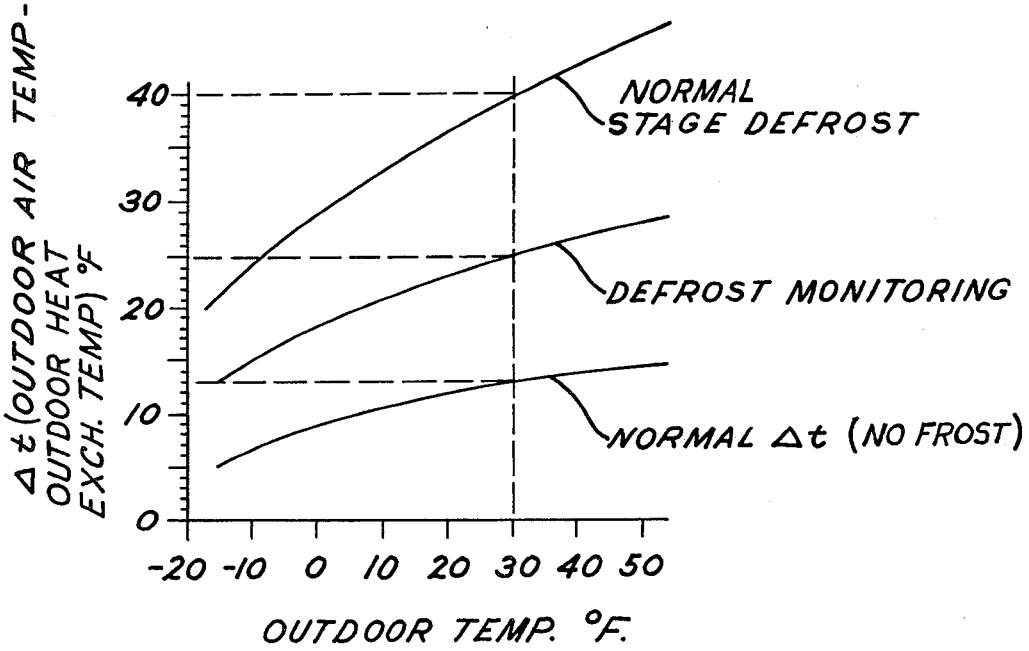
FIG. 3 is a graph illustrating the temperature ranges in which the present invention is effective.

Referring to the graph shown in FIG. 3 it will be seen that at 30° F. outdoor temperature, the normal ΔT is approximately 13° F., which means the surface temperature of the outdoor heat exchanger is 17° F. At the same 30° F. outdoor temperature, when the Δt increases to 40° F. due to frost buildup, a normal defrost cycle is initiated by sensor 64 and heat pump operation is interrupted. To reduce the occurrences of normal defrost, this invention adds the frost monitoring sensor 100. At the same 30° F. outdoor temperature with the present defrost monitoring sensor, when the Δt increases from a normal 13° F. to 25° F. due to a slight buildup of frost, the frost monitoring sensor 100 initiates a continuous run mode of operation of the outdoor fan even though the compressor may be cycling through the room thermostat 32. In this continuous outdoor fan run mode the surface of the outdoor heat exchanger will be defrosted by the scrubbing action of outdoor air when the compressor is deenergized by the room thermostat control 32.

It can be readily understood that by insuring outdoor fan operation in the temperature range where the free moisture content of the outdoor air is higher and frosting of the outdoor heat exchanger more likely to occur, the normal defrost operation can be delayed and in some conditions eliminated.

In summary, by the present invention a frost monitoring control is provided wherein frost is disposed of during operation of the unit in the normal heating mode and at those outdoor ambient temperatures when the capacity of the unit can maintain the temperature of the enclosure at its selected temperature.

The foregoing is a description of the preferred embodiment of the apparatus of the invention and it should be understood that variations may be made thereto without departing from the true spirit of the invention as defined in the appended claims.

What is claimed is:

1. In a self-contained air conditioning unit for heating and cooling an enclosure, a refrigerant circuit including an outdoor heat exchanger and an indoor heat exchanger, a compressor, a reversing valve for selectively connecting said compressor to said heat exchangers whereby said outdoor heat exchanger functions as an evaporator during operation of said unit in the heating cycle and said indoor heat exchanger functions as an evaporator during operation of said unit in the cooling cycle, fan means for moving enclosure air through said indoor heat exchanger, fan means for moving outdoor ambient air through said outdoor heat exchanger, an air conditioner heating cycle control system, comprising:

an enclosure temperature selecting thermostat having switch means operable for controlling operation of said compressor for maintaining the temperature of said enclosure within a selected temperature range;

a normal frost control means including a sensing element for detecting a layer of frost on said outdoor heat exchanger, means under control of said frost control means including a first switch means operable for energizing said compressor in the heating cycle when the temperature sensed by said sensing element is above a preselected frost accumulation level and for deenergizing said compressor and said outdoor fan means when the temperature sensed by said sensing element is below a preselected frost accumulation level;

a frost monitoring control means including a sensing element for sensing outdoor temperature and the temperature of said outdoor heat exchanger including means for insuring continuous operation of said outdoor fan when the Δt of the (outdoor air—outdoor heat exchanger temp) is a predetermined amount and said compressor is deenergized through said normal frost control means or cycling through said enclosure temperature selecting thermostat so that outdoor air circulates continuously through said outdoor heat exchanger to remove frost during compressor off period during normal cycling operation of the unit in the heating mode.

2. The self-contained air conditioning unit recited in claim 1 wherein said frost monitoring means further includes a first sensing element for sensing outdoor ambient temperature and a second sensing element for sensing outdoor heat exchanger temperature having switch means operable when the presence of frost is detected on said outdoor heat exchanger for insuring continuous operation of said outdoor fan means when said compressor is deenergized through said normal frost control means or cycling through said enclosure temperature selecting thermostat so that outdoor air is circulating during normal cycling operation of the unit in the heat cycle when said compressor is in an off period.

3. The self-contained air conditioning unit recited in claim 2 wherein said frost monitoring sensing element further includes sensing means for comparing the surface temperature of said outdoor heat exchanger and the temperature of the outside air and means for causing said second sensing element switch means to insure continuous operation of said outdoor fan means when the ΔT temperature sensed by said sensing means is at a predetermined frost producing temperature range.

4. A self-contained air conditioning unit for heating and cooling an enclosure;

a refrigerant system including a first heat exchanger and a second exchanger connected in a closed circuit;

fan means associated with each of said heat exchangers for moving air through their respective heat exchanger;

fan means operable whereby indoor air is circulated through a heat exchanger functioning as the system condenser during the heating cycle and for circulating indoor air through a heat exchanger functioning as the system evaporator during the cooling cycle;

control means including an enclosure temperature selecting thermostat having switch means operable for controlling operation of said compressor for maintaining the temperature of said enclosure within a selected temperature range;

a normal frost control means including a sensing element for detecting a layer of frost on a heat exchanger exposed to outdoor ambient and functioning as an evaporator in the heating cycle, means under control of said frost control means including a first switch means operable for energizing said compressor in the heating cycle when the temperature sensed by said sensing element is above a preselected frost accumulation level and for deenergizing said compressor and said fan means associated with said heat exchanger functioning as an evaporator when the temperature sensed by said sensing element is below a preselected frost accumulation level;

a frost monitoring control means including a sensing element for sensing outdoor temperature and the temperature of said heat exchanger functioning as an evaporator including switch means associated with said sensing element for insuring continuous operation of said fan means associated with said heat exchanger functioning as an evaporator through said switch means when the $\Delta t$ of the (outdoor air - outdoor heat exchanger temp) is a predetermined amount and said compressor is deenergized through said normal frost control means or cycling through said enclosure temperature selecting thermostat so that outdoor air circulates continuously through said heat exchanger to remove frost during the compressor off period during normal cycling operation of the unit in the heating cycle.

5. The self-contained air conditioning unit recited in claim 4 wherein said frost monitoring means further includes a first sensing element for sensing outdoor ambient temperature and a second sensing element for sensing outdoor heat exchanger temperature having switch means operable when the presence of frost is detected on said heat exchanger functioning as an evaporator for insuring continuous operation of said fan means when said compressor is deenergized through said normal frost control means cycling through said enclosure temperature selecting thermostat so that outdoor air is circulated during normal operation of the unit in the heating cycle when said compressor is in an off period.

6. The self-contained air conditioning unit recited in claim 5 wherein said frost monitoring sensing element further includes sensing means for comparing the surface temperature of said outdoor heat exchanger and the temperature of the outside air and means for causing said second sensing element switch means to insure continuous operation of said outdoor fan means when the $\Delta T$ temperature sensed by said sensing means is at a predetermined frost producing temperature range.

* * * * *